US005257556A

United States Patent [19]

Pineault

[11] Patent Number: 5,257,556

[45] Date of Patent: Nov. 2, 1993

[54] TORQUE APPLICATION TECHNIQUE AND APPARATUS

[75] Inventor: Raymond P. Pineault, Norwich, Conn.

[73] Assignee: The United States of America as represented by the Secretary of the Navy, Washington, D.C.

[21] Appl. No.: 997,264

[22] Filed: Dec. 14, 1992

[51] Int. Cl.[5] ..... B25B 13/02

[52] U.S. Cl. ..... 81/124.2; 81/180.1; 81/119; 81/60

[58] Field of Search ..... 81/119, 124.2, 180.1, 81/60–63.2

[56] References Cited

U.S. PATENT DOCUMENTS

| | | | |
|---|---|---|---|
| 2,578,686 | 12/1951 | Fish | 81/124.2 |
| 4,762,031 | 8/1988 | Bradley | 81/180.1 X |
| 5,012,707 | 5/1991 | Biagio | 81/124.2 |

*Primary Examiner*—James G. Smith
*Attorney, Agent, or Firm*—Michael J. McGowan; Prithvi C. Lall; Michael F. Oglo

[57] ABSTRACT

A tool which produces a measured torque is coupled to a bolt head or nut, located in a relatively inaccessible area, by apparatus which includes a wrench member affixed to an adaptor. The wrench member is sized and shaped to engage the fastener to be operated upon and the adaptor has a tubular construction with a tool engaging socket at one end. The adaptor is provided with an elongated slot which accommodates any wires which may pass through the fastener.

9 Claims, 2 Drawing Sheets

TORQUE APPLICATION TECHNIQUE AND APPARATUS

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION (1) Field of the Invention

The present invention relates to the transmission of torque, for example as generated by a tool which provides a measurable mechanical advantage, to a nut or a bolt head and particularly to the application of a desired torque to a hull fitting nut. More specifically, this invention is directed to a tool which enables a known rotational force to be applied to a fastener located where there is insufficient space to directly connect the force producer thereto, and particularly to a tool for tightening hull fittings, which have wires extending therethrough, to a required degree. Accordingly, the general objects of the present invention are to provide novel and improved methods and apparatus of such character.

(2) Description of the Prior Art

While not limited thereto in its utility, the present invention is believed to be particularly well suited for use in the removal and installation of hull penetration fittings. Because such fittings are typically located in an area which is characterized by mechanical congestion, and also because of the placement of the connection wires which extend through the fitting, in many cases it has not previously been possible to employ a tool which provides a measured torque to tighten the fitting nut. It is desirable, and in some cases necessary, to apply a predetermined torque force to the nut of a hull penetration fitting. Torque wrenches, i.e., manually operable wrenches which provide a mechanical advantage and a read-out of the generated torque, are well known and generally available. For the reasons briefly stated above, these known torque wrenches were not suitable for use in an environment where the congestion caused by wires extending through the member to which the torque is to be applied, and the presence of other equipment, severely limited the amount of possible radial movement of the torque wrench handle.

SUMMARY OF THE INVENTION

The present invention overcomes the above briefly discussed and other deficiencies and disadvantages of the prior art by providing a novel technique for applying a known torque to a hull fitting nut or the like during the course of the removal or installation thereof. The present invention also encompasses apparatus for use in the implementation of this technique, the apparatus permitting a tool which provides a measured torque to be coupled to the member which is to be tightened or released.

Apparatus in accordance with the preferred embodiment of the invention includes an open-ended wrench which is sized and shaped to engage either a hexagonal or spanner nut, i.e., a nut with a cylindrical outer surface with longitudinal slots thereon. The wrench will typically have a handle portion which extends outwardly at an angle from the plane of the nut engaging portion. In accordance with the invention, the nut engaging portion of the wrench is modified so that an adaptor may be mechanically affixed thereto on the side which corresponds to the direction of outward handle extension. The adaptor is of generally tubular construction and is provided with an opening at one side to accommodate any wires which extend through the nut. At the end thereof which is disposed oppositely with respect to the open-ended wrench, the adaptor is provided with a base which defines a socket, the socket being located so as to be coaxial with a nut which will be engaged by the wrench affixed to the adaptor. This socket is designed to be engaged either directly by the output arm of the torque wrench or, as is the more common arrangement, by a ratchet mechanism. Where a ratchet mechanism is employed, it will be secured in the socket in the adaptor and, subsequently, engaged by the torque wrench.

BRIEF DESCRIPTION OF THE DRAWINGS

The present invention may be better understood, and its numerous objects and advantages will become apparent to those skilled in the art, by reference the accompanying drawings wherein like reference numerals refer to like elements in the several figures and in which.

DESCRIPTION OF THE PREFERRED EMBODIMENT

Figure 1:
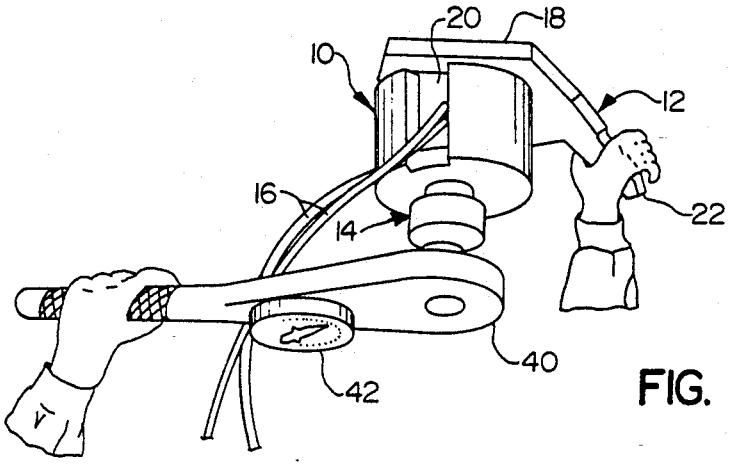
FIG. 1 is a perspective view which shows practice of the present invention employing apparatus in accordance with a preferred embodiment thereof.

With reference now to the drawings, the apparatus of the disclosed embodiment of the invention includes an adaptor, indicated generally at 10, an open-ended or a close-ended wrench, indicated generally at 12, and in most cases a ratchet mechanism, indicated generally at 14. The apparatus is particularly well suited for use in installation or removal of a hull penetration fitting which will typically have electrical wires 16 extending therethrough. Accordingly, the wrench 12 will have a nut engaging portion 18 which, in the disclosed embodiment, is sized and shaped to engage a hexagonal nut 20 of the hull penetration fitting. The wrench 12 also has a handle 22 which extends outwardly from the nut engaging portion 18 at an angle. In a typical embodiment, the angle between the planes defined by portions 18 and 22 of wrench 10 will be 45°. However, this angle can be varied without deviating from the teachings of the present invention. The nut engaging portion 18 of the wrench 12 is provided with a plurality of counter bores 24 which receive screws 26. The screws 26 are provided with hexagonal sockets in the head portions thereof and, when installed, the heads of the screws will be flush with or slightly below the plane of the face of portion 18 of wrench 12.

The adaptor 10 of the disclosed embodiment of the invention is a generally cylindrical-shaped member which is open at the end which is to abut the portion 18 of wrench 12. The adaptor is provided with a plurality of tapped holes 28 which are located so as to be threadably engaged by the screws 26 whereby the wrench may be attached to the adaptor. The adaptor is also provided with a cut-out 30 in the side thereof. In the disclosed embodiment, this cut-out extends into the base 32 of adaptor 10. A socket 34 will be formed in the base 32 of adaptor 10. The socket 34 will be coaxial with the adaptor and will thus also be coaxial with any fastener which is engaged by the wrench 12. Socket 34 is sized and shaped, in the disclosed embodiment, to receive the output shaft, i.e., the shank 36, of the ratchet 14. A radially extending threaded bore is provided in the base 32 of adaptor 10, the bore intersecting the socket 34. This bore receives a set screw 38 which may be tightened against the shank 36 of the ratchet 14 to capture the ratchet in the socket 34 of adaptor 10.

Figure 2:
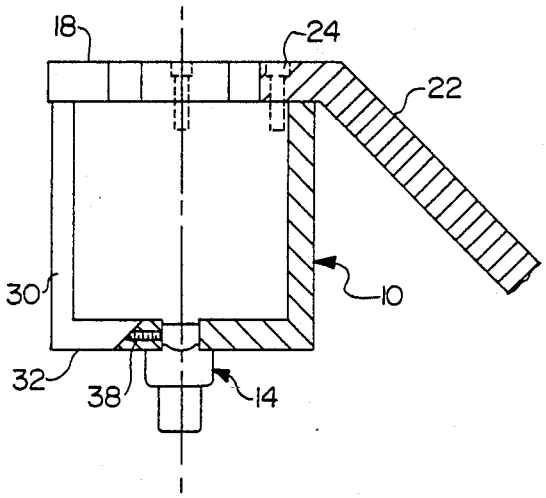
FIG. 2 is an exploded perspective view of the apparatus of FIG.1.
Figure 3:
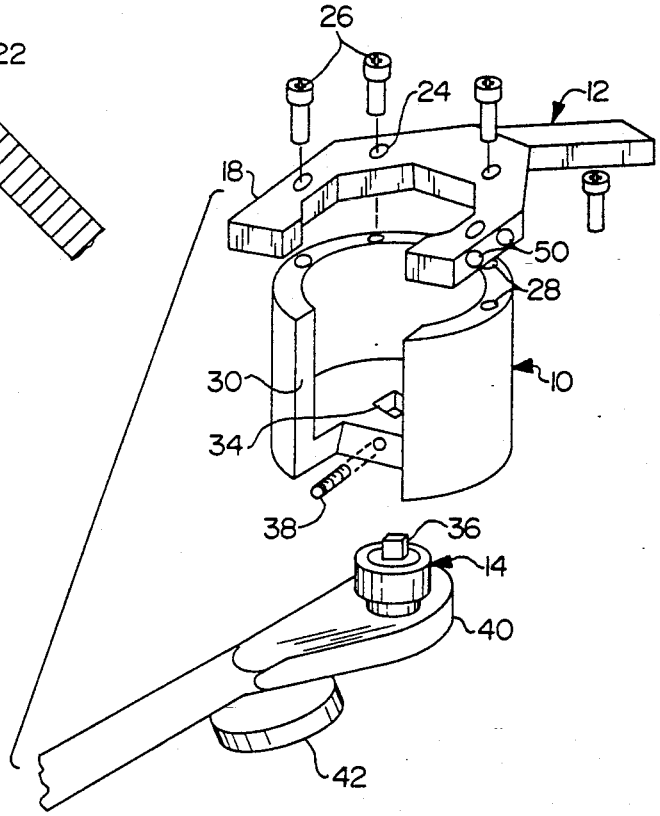
FIG. 3 is a side elevation view, partially in section, showing the apparatus of FIGS. 1 and 2.

The apparatus of the disclosed embodiment of the present invention is shown in the assembled state in FIG. 2 and is shown in FIG. 1 in its in-use condition where the ratchet mechanism 14 has been engaged by a torque wrench 40. Wrench 40 is provided with a visually observable gauge 42 which enables the torque force which is instantaneously generated to be monitored. In use, a nut 20 which is to be tightened will be engaged by the wrench 12 for a hexagonal nut as shown in FIG. 3. The wrench is then employed to hand tighten the nut. When the nut has been hand tightened, if the ratchet 14 has not already been secured to adaptor, the ratchet shank 36 will be inserted into the socket 34 and the set screw 38 tightened. Next, employing the torque wrench 40, the desired torque will be applied to nut 20. Because of the congested space and the presence and placement of the wires 16, very limited radial movement of the wrench 12 is possible. The ratchet mechanism 14 allows minimal rotational movement of nut 20 and the cut-out segment 30 of adaptor 10 allows the hull fitting wires 16 to fair naturally. Should the wires restrict the rotational movement of the adaptor to a degree which precludes tightening of the nut to the desired degree, the adaptor and wrench 12 may be repositioned on the nut 20 to allow further tightening.

Figure 4:
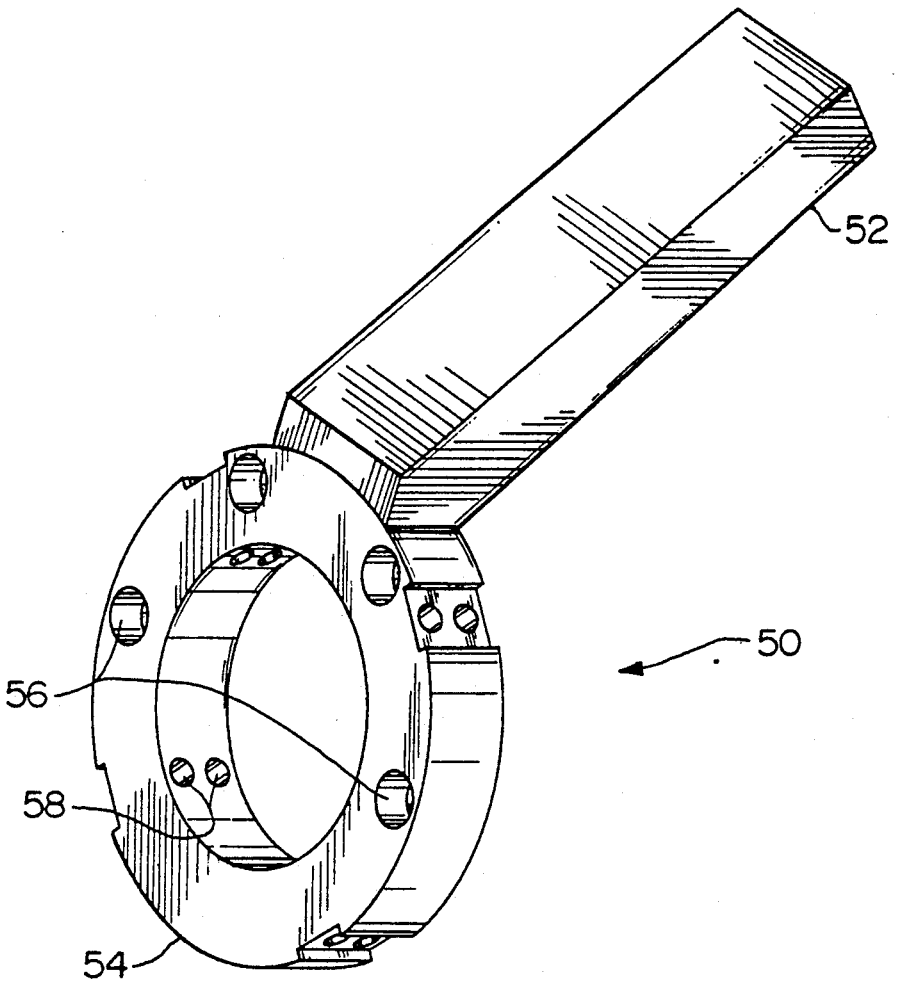
FIG. 4 is a perspective view of a part of FIG. 3 but depicting a different embodiment.

In accordance with another embodiment of the invention, the wrench portion is designed for use with a spanner nut. A wrench which engages a spanner nut is indicated generally at 50 in FIG. 4 and includes a handle 52 and a cylindrical portion 54. Portion 54 is provided with bores 56 which correspond to the counter bores 24 in wrench 10. Screws, not shown, are received in tapped holes 58 and engage the longitudinal slots in a spanner nut.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. Apparatus for coupling a torque producing tool to a mechanical fastener comprising:

a wrench, said wrench being sized and shaped to engage a fastener to which torque is to be applied, the wrench having a fastener engaging portion which is symmetrical with respect to an axis and a handle portion which extends outwardly from said fastener engaging portion;

adaptor means, said adaptor means comprising an elongated member which defines an axis, said adaptor means having a generally tubular construction and being open at a first end thereof, said adaptor means further having a cut-out in a side wall thereof whereby communication between the exterior of said adaptor means and the interior space thereof is established, said adaptor means further defining a socket in a second end thereof which is disposed oppositely with respect to said first end thereof; and means for affixing said wrench to said adaptor means first end whereby said wrench and adaptor means will define an integral structure and said fastener engaging portion of said wrench will be coaxial with said adaptor means.

2. The apparatus of claim 1 further comprising:

ratchet means, said ratchet means having an output shaft which is engaged in said socket in said adaptor means second end; and means for capturing said ratchet means shaft in said adapter means socket.

3. The apparatus of claim 1 wherein said wrench handle portion defines an open-ended wrench with a generally planar surface and wherein said handle portion defines a plane which intersects the plane of said fastener engaging portion at an angle.

4. The apparatus of claim 2 wherein said wrench handle portion defines an open-ended wrench with a generally planar surface and wherein said handle portion defines a plane which intersects the plane of said fastener engaging portion at an angle.

5. The apparatus of claim 1 wherein said means for affixing comprises a plurality of spaced bolts which pass through said fastener engaging portion of said wrench and threadably engage said adaptor means.

6. The apparatus of claim 5 wherein said wrench handle portion defines an open-ended wrench with a generally planar surface and wherein said handle portion defines a plane which intersects the plane of said fastener engaging portion at an angle.

7. The apparatus of claim 6 further comprising:

ratchet means, said ratchet means having an output shaft which is engaged in said socket in said adaptor means second end; and means for capturing said ratchet means shaft in said adaptor means socket.

8. The apparatus of claim 1 wherein said wrench is configured to engage a hexagonal fastener.

9. The apparatus of claim 1 wherein said wrench is configured to engage a spanner nut.

* * * * *